US011879696B2

(12) United States Patent
Smith et al.

(10) Patent No.: US 11,879,696 B2
(45) Date of Patent: Jan. 23, 2024

(54) SECTIONAL RADIATOR SEAL ARRANGEMENT

(71) Applicant: Bearward Engineering Limited, Northampton (GB)

(72) Inventors: Martin Smith, Northampton (GB); George Wilson-Fitzgerald, Northampton (GB)

(73) Assignee: Bearward Engineering Limited, Northampton (GB)

( * ) Notice: Subject to any disclaimer, the term of this patent is extended or adjusted under 35 U.S.C. 154(b) by 746 days.

(21) Appl. No.: 16/617,439

(22) PCT Filed: May 30, 2018

(86) PCT No.: PCT/IB2018/053861
§ 371 (c)(1),
(2) Date: Nov. 26, 2019

(87) PCT Pub. No.: WO2018/220560
PCT Pub. Date: Dec. 6, 2018

(65) Prior Publication Data

US 2020/0158448 A1 May 21, 2020

Related U.S. Application Data

(60) Provisional application No. 62/512,816, filed on May 31, 2017.

(51) Int. Cl.
*F28F 9/02* (2006.01)
*F28D 1/053* (2006.01)

(52) U.S. Cl.
CPC ..... *F28F 9/0219* (2013.01); *F28D 1/05383* (2013.01); *F28F 2230/00* (2013.01)

(58) Field of Classification Search
CPC ..... F28F 9/0219; F28F 2230/00; F28D 1/05383
See application file for complete search history.

(56) References Cited

U.S. PATENT DOCUMENTS 4,191,244 A * 3/1980 Keske ..... F28F 9/06 165/69
4,730,668 A 3/1988 LeMaster
5,137,080 A * 8/1992 Haasch ..... F28D 1/05325 165/69

(Continued)

FOREIGN PATENT DOCUMENTS

EP 0519615 A1 12/1992

OTHER PUBLICATIONS

1st Office Action for corresponding Chinese Utility Model Application No. 2018900008965 issued by the CNIPA dated Jul. 6, 2020.

(Continued)

*Primary Examiner* — Tho V Duong
*Assistant Examiner* — Raheena R Malik
(74) *Attorney, Agent, or Firm* — Joseph M. Butscher; The Small Patent Law Group LLC

(57) ABSTRACT

A sectional radiator seal arrangement including a sectional radiator having a core and a bonnet, a nozzle defined by a cylindrical sidewall extending from and in fluid communication with the bonnet and the core, the nozzle configured for creating a seal with a radiator tank and a sleeve formed from a corrosion resistant material fitted about a portion of the cylindrical sidewall of the nozzle. A retaining compound can be provided between the sleeve and the radiator tank for preventing an ingress of coolant at the seal and into contact with either the nozzle or the bonnet. A method of reducing corrosion of the radiator seal also is provided.

22 Claims, 2 Drawing Sheets

(56) References Cited

U.S. PATENT DOCUMENTS

| | | | | |
|---|---|---|---|---|
| 5,429,183 | A * | 7/1995 | Hisamori | F28F 9/0246 165/905 |
| 5,785,114 | A * | 7/1998 | Armstrong | F28D 7/06 165/47 |
| 5,984,001 | A * | 11/1999 | Welkey | F28F 9/0219 165/158 |
| 8,631,859 | B1 * | 1/2014 | Hettrich | F28F 9/262 165/144 |
| 2011/0042047 | A1 * | 2/2011 | Karl | F28F 17/005 165/158 |
| 2014/0196700 | A1 * | 7/2014 | Bucher | F28D 7/1684 165/158 |
| 2014/0225363 | A1 * | 8/2014 | Burgers | F28F 9/0258 285/124.5 |
| 2016/0069620 | A1 * | 3/2016 | Kennedy | F16J 15/0887 277/626 |
| 2017/0268413 | A1 * | 9/2017 | Kinder | F28D 1/06 |
| 2017/0370661 | A1 * | 12/2017 | McGee | F28F 19/04 |

OTHER PUBLICATIONS

English translation of the 1st Office Action for corresponding Chinese Utility Model Application No. 2018900008965 issued by the CNIPA dated Jul. 6, 2020.

Office Action dated Jun. 8, 2021 for corresponding European patent application No. 18734302.5 (5 pages).

First Examination Report dated Jul. 30, 2021 for corresponding Indian patent application No. 201917048342 (6 pages).

International Search Report for corresponding PCT/IB2018/053861 dated Sep. 25, 2018.

International Preliminary Report on Patentability for corresponding PCT Application No. PCT/IB2018/053861 dated Dec. 3, 2019 (7 pages).

* cited by examiner

SECTIONAL RADIATOR SEAL ARRANGEMENT

CROSS-REFERENCE TO RELATED APPLICATIONS

This application is a national stage application, filed pursuant to 35 U.S.C. § 371, of International Patent Application No. PCT/IB18/53861, filed 30 May 2018, which claims priority to U.S. Patent Application No. 62/512,816, filed 31 May 2017. The entire disclosures of these applications are incorporated herein.

BACKGROUND

Technical Field

The present disclosure is directed to a sectional radiator including a nozzle and, more particularly, to a radiator seal arrangement for the nozzle that enables relative movement of the nozzle during expansion and contraction of the sectional radiator core while maintaining the seal and reducing corrosion at the nozzle interface.

Discussion of Art

Sectional radiator cores are generally known in the radiator art. The principal purpose of the sectional radiator core design is to allow the core to expand and contract under thermal expansion. A nitrile seal is generally provided at the nozzle interface of the bonnet of the core to the tank to allow the bonnet/core to expand and contract under thermal expansion. A standard nitrile rubber grommet seal is typically provided between the interface of the core nozzle and the tank to allow for relative movement of the nozzle with respect to the tank, while maintaining the seal. The core and the nozzles are typically formed from aluminum. During use of the radiator, corrosive material can build up at the interface between the nozzle and the tank, severely reducing the life expectancy of the seal.

BRIEF DESCRIPTION

In accordance with one embodiment, the present invention is directed to a sectional radiator seal arrangement for extending the life expectancy of the seal. The seal arrangement includes a sectional radiator including a core and a bonnet, a nozzle defined by a cylindrical sidewall extending from and in fluid communication with the bonnet and core, the nozzle configured for creating a seal with a radiator tank, and a sleeve fitted about a portion of the cylindrical sidewall of the nozzle. The sleeve is formed from a corrosion resistant material, such as brass, however, it can be appreciated that other corrosion resistant materials can be used to form the sleeve. The nozzle and the bonnet are typically formed from aluminum which corrosively reacts with the coolant and creates pitting at the nozzle and the adjacently disposed portions of the bonnet. A retaining compound can be applied that prevents the ingress of coolant at the seal and further increases the service life of the sealing arrangement. According to one embodiment, the sealant can be a methacrylate ester retaining compound, such as a Loctite® product designation 640 or Loctite® product designation 648, both of which are commercially available by the Henkel Corporation. The retaining compound is configured to prevent the ingress of coolant between the bonnet and the radiator tank, as well as, between the nozzle and sleeve.

The sleeve can include a flared flange at a first end to aid in fitting the sleeve onto the bonnet, wherein upon installation about the nozzle, the flared flange is positioned adjacent to the bonnet and flares out into contact with a flat portion of the bonnet. The sleeve can also include an internal lip located at a second end opposite to the flared flange, which is located at the first end. The sleeve has a predetermined height such that the internal lip is positioned slightly below an end portion of the nozzle so as to create a smooth transition from the end portion of the nozzle to the sleeve. The sleeve can also be constructed to have a predetermined diameter so that upon placement onto the nozzle, an interference fit is created with the nozzle.

In accordance with another embodiment, the present invention is directed to a method of reducing corrosion of a sectional radiator seal comprising providing a sectional radiator including a core, a bonnet, and a nozzle extending from and in fluid communication with the bonnet and the core, the nozzle being defined by a cylindrical sidewall having an end portion configured for creating a seal with a radiator tank and fitting a sleeve about a portion of the cylindrical sidewall of the nozzle. The sleeve is formed from a corrosion resistant material, such as brass or other known corrosion-resistant, non-reactive materials. The method further includes applying a retaining compound to the seal, the retaining compound configured for preventing an ingress of coolant at the seal. The nozzle and the bonnet are typically formed from aluminum and the retaining compound can be a methacrylate ester retaining compound, such a Loctite® product designation 640 or Loctite® product designation 648. The sleeve includes a flared flange at a first end to aid in fitting the sleeve onto the bonnet such that the flared flange is positioned adjacent to a flat portion of the bonnet. The sleeve can further include an internal lip located at a second end opposite to the flared flange located at the first end. The sleeve is formed to have a predetermined height such that upon placement of the sleeve on the nozzle, the internal lip is positioned slightly below the end portion of the nozzle so as to create a smooth transition from the end portion of the nozzle to the sleeve. The sleeve can also be provided with a predetermined diameter so that upon placement onto the nozzle, an interference fit is created with the nozzle.

In accordance with yet another embodiment, the present invention is directed to a method of retrofitting a nozzle of a sectional radiator with a corrosion resistant seal arrangement comprising fitting a sleeve about a portion of a cylindrical sidewall of the nozzle, wherein the sleeve is formed from a corrosion resistant material. The method can also include applying a retaining compound to the seal, the retaining compound configured for preventing an ingress of coolant at the seal. According to one embodiment, the corrosion resistant material can be brass, and the sealant can be a methacrylate ester retaining compound, such a Loctite® product designation 640 or Loctite® product designation 648.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
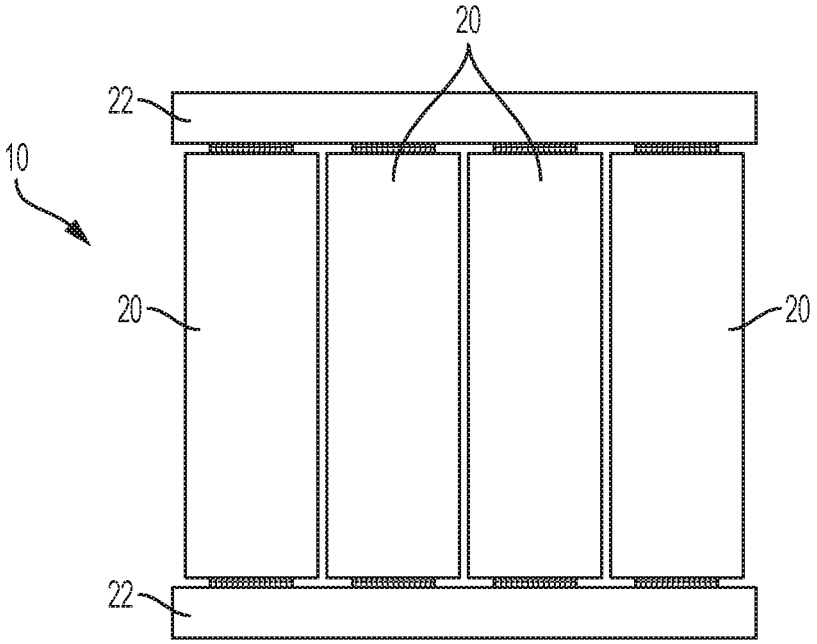
FIG. 1 is a schematic front view of a radiator including multiple sectional radiator cores in accordance with one embodiment of the present disclosure.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that like reference numerals are being used throughout the drawings to depict like components throughout the figures. It is further understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
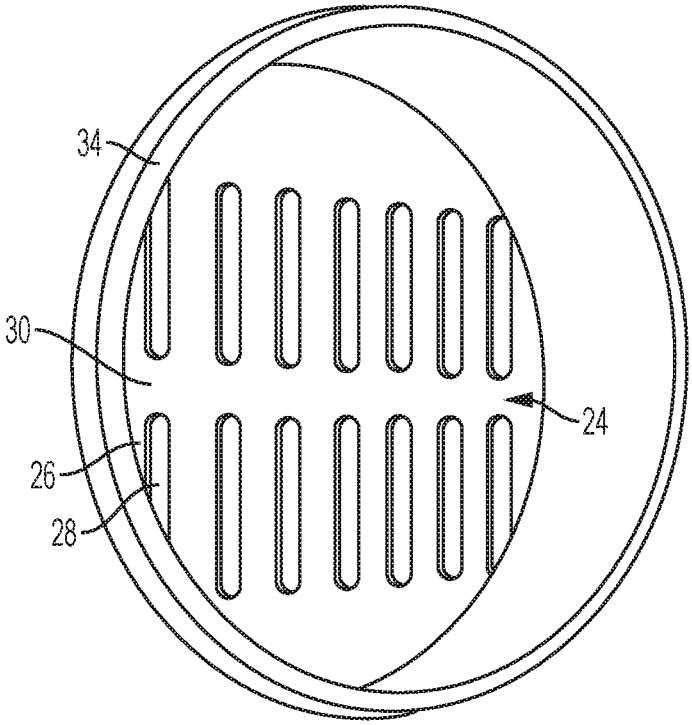
FIG. 2 is a bottom sectional view of FIG. 1 showing internal surfaces of a core header plate and tube in accordance with the present disclosure.

Reference is now made to FIG. 1 which shows a schematic front view of a radiator, generally indicated as 10, including multiple sectional radiator cores 20 and a pair of tanks 22 located at opposite ends of the radiator cores 20, in accordance with one embodiment of the present disclosure. Radiators 10 can be used in a variety of applications, such as air-to-air after-cooler assemblies, exhaust gas recirculation coolers, and the like, wherein the series of tubes is laid out according to various arrangements. With continuing reference to FIG. 1 and with further reference to FIG. 2, each of the sectional radiator cores 20 include a tube core 24 made up from a series of tubes 26. The tubes 26 can be used in junction with any type of fin and tube arrangement. These arrangements include, but are not limited to, staggered, parallel, canted, plate fin, Serpentine, Conn., and the like. According to the arrangement shown in FIG. 2, the tubes 26 forming the core 24 are positioned parallel to each other and inserted into openings 28 in a header 30. According to an alternative arrangement, the tubes 26 forming the core 24 can be positioned in a staggered array and inserted into openings in the header. The staggered array arrangement provides less tube side pressure drop as the core includes more tubes in the same volume of core as the core arrangement of FIG. 2, given that the web or minimum distance between the openings 28 in the header 30 remains the same. It can be appreciated that any type of header can be used in connection with the presently-invented arrangement. For example, the header can be soldered, brazed, welded or mechanically bonded to the tubes. Any such attachment or joining methodology is envisioned for fixing the tubes 26 of each core 24 to the header 30.

Figure 3:
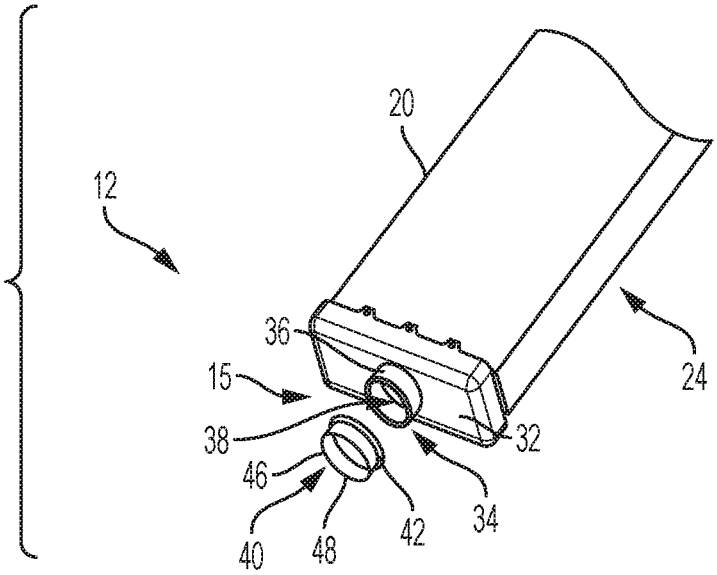
FIG. 3 shows a partial bottom perspective view of a sectional radiator core and nozzle of FIG. 1 wherein the sleeve has been separated from the nozzle in accordance with the present disclosure.
Figure 4:
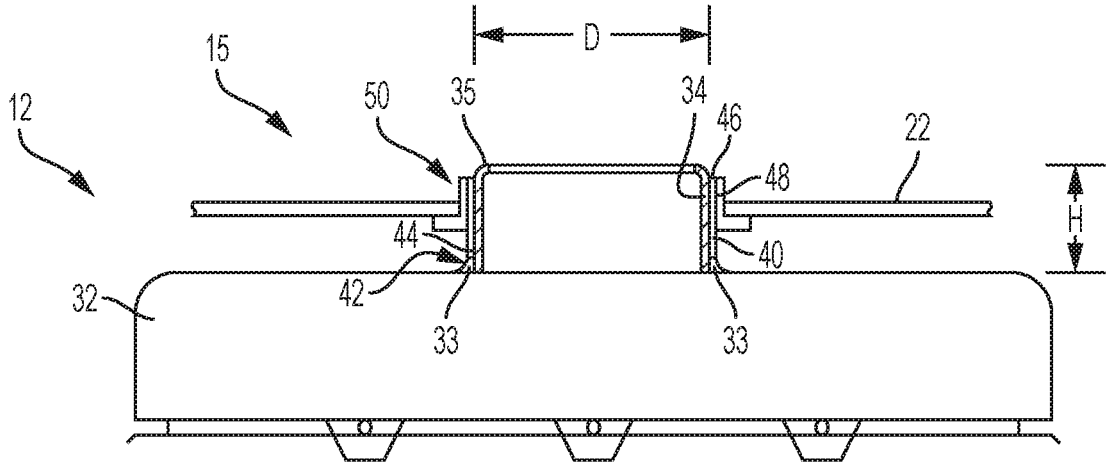
FIG. 4 is a cross-sectional side view of the nozzle located on a sectional radiator core of FIG. 1 in accordance with another embodiment of the present disclosure.

Reference is now made to FIGS. 3-4 which show the sectional radiator seal, generally indicated as 12, in accordance with the present invention. The sectional radiator seal arrangement 12 can be used to extend the life expectancy of the seal 15. The seal 15 includes the sectional radiator 20 having the core 24 and a bonnet 32 located thereon. A nozzle 34 defined by a cylindrical sidewall 36 extends from and in fluid communication with the bonnet 32 via opening 38. The nozzle 34 is configured for creating a seal with the radiator tank 22. A cylindrical sleeve 40 is fitted about a portion of the cylindrical sidewall 36 of the nozzle 34. The sleeve 40 is formed from a corrosion resistant material, such as brass, however, it can be appreciated that other corrosion resistant materials can be used to form the sleeve. The bonnet 32 and the nozzle 34 are typically formed from aluminum which corrosively reacts with the coolant within the radiator and creates pitting on the nozzle 34 and the adjacently disposed portions of the bonnet 32.

A retaining compound 50, as shown in FIG. 4, can be applied that prevents the ingress of the coolant at the seal and further increases the service life of the sealing arrangement 15. According to one embodiment, the sealant can be a methacrylate ester retaining compound, such as a Loctite® product designation 640 or Loctite® product designation 648, both of which are commercially available by the Henkel Corporation. It can be appreciated that other well-known sealant materials can be used. The retaining compound is configured to prevent the ingress of coolant between the bonnet 32 and the radiator tank 22, as well as, between the nozzle 34 and sleeve 40. The radiator seal 15 must be constructed to ensure that relative movement of the nozzle 34 during expansion and contraction of the sectional radiator core 20 can occur while maintaining the seal 15 and reducing corrosion at the nozzle interface.

With continuing reference to FIGS. 3-4, the sleeve 40 can include a flared flange 42 at a first end 44 to aid in fitting the sleeve onto a surrounding flat portion 33 of the bonnet 32 wherein upon installation of the sleeve 40 about the cylindrical sidewall 36 of the nozzle 34, the flared flange 42 is positioned adjacent to the bonnet 32 and flares out into contact with the surrounding flat portion 33 of the bonnet 32. The sleeve 40 can also include an internal lip 46 located at a second end 48 of the sleeve 40 and opposite to the flared flange 42 located at the first end 44. The sleeve 40 has a predetermined height H such that the internal lip 46 is positioned slightly below an end portion 35 of the nozzle 34 so as to create a smooth transition from the end portion 35 of the nozzle 34 to the sleeve 40. The sleeve 40 can also be constructed to be cylindrical in shape and have a predetermined diameter D so that upon placement onto the nozzle 34, an interference fit is created between the sleeve 40 and the nozzle 34. It can be appreciated that the sleeve 40 can be secured onto the nozzle by other techniques such as brazing, welding, gluing, mechanical interlocking, and the like.

Referring back to FIGS. 1-2 along with FIGS. 3-4, a method of reducing corrosion of a sectional radiator seal 15 comprises providing a sectional radiator including a core 20, a bonnet 32, and a nozzle 34 extending from and in fluid communication with the bonnet 32. The nozzle 34 is defined by a cylindrical sidewall 36 having an end portion 35 configured for creating a seal with a radiator tank 22 and fitting a sleeve 40 about a portion of the cylindrical sidewall 36 of the nozzle 34. As discussed above, the sleeve 40 is formed from a corrosion resistant material, such as brass or other well-known corrosion-resistant, non-reactive materials. The method further includes applying a retaining compound 50 to the seal 15, the retaining compound configured for preventing an ingress of coolant used in the radiator 10 at the seal 15. The nozzle 34 and the bonnet 32 are typically formed from aluminum which reacts with the coolant and can become eroded and/or pitted. The retaining compound 50 can be a methacrylate ester retaining compound, such as a Loctite® product designation 640, Loctite® product designation 648, or any other well-known sealant material. The sleeve 40 can be cylindrical in shape and includes a flared flange 42 at a first end 44 to aid in fitting the sleeve 40 onto the bonnet 32 such that the flared flange 42 is positioned adjacent to a flat portion 33 of the bonnet 32 surrounding the nozzle 34. The sleeve 40 can further include an internal lip 46 located at second end 48 opposite to the flared flange 42 located at the first end 44. The sleeve 40 is formed to have a predetermined height H such that upon placement of the sleeve 40 onto the nozzle 34, the internal lip 46 is positioned slightly below the end 35 of the nozzle 34 so as to create a smooth transition from the end portion 35 of the nozzle 34 to the sleeve 40. The sleeve 40 can also be provided with a predetermined diameter D which is substantially the same as a diameter of the nozzle so that upon placement of the sleeve 40 onto the nozzle 34, an interference fit is created between the sleeve 40 and the nozzle 34. As stated above, other well-known techniques can be used for securing the sleeve 40 to the nozzle 34.

It can be appreciated that the corrosion resistant seal 15 of the present invention can be retrofitted onto an already constructed sectional radiator core 20 by fitting the corrosion-resistant sleeve 40 about a portion of a cylindrical sidewall 36 of the nozzle 34. The method can also include applying a retaining compound 50 to the seal to prevent an ingress of coolant at the seal 15. The sleeve 40 can be secured onto the nozzle 34 by an interference fit, brazing, welding, mechanical interlocking, and any other well-known techniques.

Further examples of the present disclosure will now be described in the following numbered clauses.

Clause 1: A sectional radiator seal arrangement comprising: (a) a sectional radiator including a core (20) and a bonnet (32); (b) a nozzle (34) defined by a cylindrical sidewall (36) extending from and in fluid communication with the bonnet (32) and core (20), the nozzle (34) configured for creating a seal with a radiator tank (22) ; and (c) a sleeve (40) fitted about a portion of the cylindrical sidewall (36) of the nozzle (34), said sleeve (40) being formed from a corrosion resistant material.

Clause 2: The arrangement according to clauses 1 or 2, including a retaining compound (50) for preventing an ingress of coolant at the seal (15).

Clause 3: The arrangement according to clause 2, wherein the retaining compound (50) is configured to prevent the ingress of coolant between the bonnet (32) and the radiator tank (22).

Clause 4: The arrangement according to clause 2, wherein the retaining compound is configured to prevent the ingress of coolant between the nozzle (34) and sleeve (40).

Clause 5: The arrangement according to clause 2, wherein the retaining compound (50) comprises a methacrylate ester retaining compound.

Clause 6: The arrangement according to any one of clauses 1-5, wherein the nozzle (34) and the bonnet (32) are formed from aluminum.

Clause 7: The arrangement according to any one of clauses 1-6, wherein the sleeve (40) is formed from brass.

Clause 8: The arrangement according to any one of clauses 1-7, wherein the sleeve (40) includes a flared flange (42) at a first end (44) to aid in fitting the sleeve (40) onto the bonnet (32) such that the flared flange (42) is positioned adjacent to the bonnet (32).

Clause 9: The arrangement according to clause 8, wherein the sleeve (40) includes an internal lip (46) located at a second end (48) opposite to the flared flange (42) located at the first end (44).

Clause 10: The arrangement according to clause 9, wherein the sleeve (40) has a predetermined height such that the internal lip (46) is positioned below an end portion (35) of the nozzle (34) so as to create a smooth transition from the end portion (35) of the nozzle (34) to the sleeve (40).

Clause 11: The arrangement according to any one of clauses 1-10, wherein the sleeve (40) has a predetermined diameter (D) so as to create an interference fit with the nozzle (34).

Clause 12: A method of reducing corrosion of a sectional radiator seal (15), said method comprising: (a) providing a sectional radiator (10) including a core (20), a bonnet (32), and a nozzle (34) extending from and in fluid communication with the bonnet (32) and the core (20), the nozzle (34) being defined by a cylindrical sidewall (36) having an end portion (35) configured for creating a seal with a radiator tank (22); and (b) fitting a sleeve (40) about a portion of the cylindrical sidewall (36) of the nozzle (34), said sleeve (40) being formed from a corrosion resistant material.

Clause 13: The method according to clause 12, including applying a retaining compound (50) to the seal (15), the retaining compound configured for preventing an ingress of coolant at the seal (15).

Clause 14: The method according to clause 13, wherein the nozzle (34) and the bonnet (32) are formed from aluminum, the sleeve (40) is formed from brass, and the retaining compound (50) comprises a methacrylate ester retaining compound.

Clause 15: The method according to any one of clauses 12-14, wherein the sleeve (40) includes a flared flange (42) at a first end (44) to aid in fitting the sleeve (40) onto the bonnet (32) such that the flared flange (42) is positioned adjacent to the bonnet (32), the sleeve (40) further including an internal lip (46) located at second end (48) opposite to the flared flange (42) located at the first end (44).

Clause 16: The method according to clause 15, wherein the sleeve (40) has a predetermined height (H) such that upon placement of the sleeve (40) on the nozzle (34), the internal lip (46) is positioned below the end portion (35) of the nozzle so as to create a smooth transition from the end portion (35) of the nozzle (34) to the sleeve (40).

Clause 17: The method according to any one of clauses 12-16, comprising providing the sleeve (40) with a predetermined diameter (D) so as to create an interference fit with the nozzle (34).

Clause 18: A method of retrofitting a nozzle (34) of a sectional radiator with a corrosion resistant seal (15), the method comprising fitting a sleeve (40) about a portion of a cylindrical sidewall (36) of the nozzle (34), said sleeve (40) being formed from a corrosion resistant material.

Clause 19: The method according to clause 18 including applying a retaining compound (50) to the seal (15), the retaining compound (50) configured for preventing an ingress of coolant at the seal (15).

Clause 20: The method according to clauses 18 or 19, wherein the corrosion resistant material comprises brass.

It is to be understood that the invention may assume various alternative variations and step sequences, except where expressly specified to the contrary. It is also to be understood that the specific devices and processes illustrated in the attached drawings and described in the specification, are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that, to the extent possible, one or more features of any embodiment or aspect can be combined with one or more features of any other embodiment or aspect The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A radiator arrangement comprising:

a sectional radiator including a core and a bonnet;

a nozzle defined by a cylindrical sidewall in fluid communication with the bonnet and the core, the nozzle formed of aluminum, and the nozzle configured for creating a seal within an opening in a radiator tank at an interface between the nozzle and the opening of the radiator tank;

a retaining compound for preventing an ingress of collant at the seal; and a corrosion-resistant material provided about at least a portion of the cylindrical sidewall of the nozzle, wherein the corrosion-resistant material comprises a sleeve.

2. The arrangement of claim 1, wherein the retaining compound is configured to prevent the ingress of the coolant between the bonnet and the radiator tank.

3. The arrangement of claim 1, wherein the retaining compound is configured to prevent the ingress of the coolant between the nozzle and the corrosion-resistant material.

4. The arrangement of claim 1, wherein the retaining compound comprises a methacrylate ester-retaining compound.

5. The arrangement of claim 1, wherein the the bonnet include aluminum.

6. The arrangement of claim 1, wherein the sleeve includes brass.

7. The arrangement of claim 1, wherein the sleeve is fitted about the at least the portion of the cylindrical sidewall of the nozzle.

8. The arrangement of claim 7, wherein the sleeve includes a flared flange at a first end to fit the sleeve onto the bonnet such that the flared flange is positioned adjacent to the bonnet.

9. The arrangement of claim 7, wherein the sleeve has a predetermined diameter that creates an interference fit with the nozzle.

10. The arrangement of claim 1, wherein the seal comprises a grommet or a nitrile seal.

11. A method comprising:

providing a sectional radiator including a core, a bonnet, and a nozzle formed of aluminum, the nozzle in fluid communication with the bonnet and the core, the nozzle having a cylindrical sidewall configured for creating a seal within an opening in a radiator tank;

applying a retaining compound to the seal, the retaining compound configured for preventing an ingress of coolant at the seal; and providing a corrosion-resistant surface about at least a portion of the cylindrical sidewall of the nozzle, wherein the corrosion-resistant surface comprises a sleeve.

12. The method of claim 11, wherein providing the sectional radiator and providing the corrosion-resistant surface comprise one or both of:

providing the bonnet that include aluminum, or providing the retaining compound that includes a methacrylate ester-retaining compound.

13. The method of claim 11, wherein providing the corrosion-resistant surface forms the sleeve about the at least the portion of the cylindrical sidewall of the nozzle.

14. The method of claim 13, wherein the sleeve includes a flared flange at a first end to aid in fitting the sleeve onto the bonnet such that the flared flange is positioned adjacent to the bonnet, the sleeve further including an internal lip located at a second end opposite to the flared flange located at the first end.

15. The method of claim 11, wherein the sleeve includes brass.

16. The method of claim 11, wherein the sleeve is provided with a predetermined diameter to create an interference fit with the nozzle.

17. A method comprising:

providing a corrosion-resistant sleeve about at least a portion of a cylindrical sidewall of an aluminum nozzle of a sectional radiator; and applying a retaining compound to a seal of the aluminum nozzle, the retaining compound configured for preventing an ingress of cooland at the seal.

18. The method of claim 17, wherein the retaining compound is applied to a grommet or a nitrile seal as the seal.

19. A radiator arrangement comprising:

a sectional radiator including a core and a bonnet;

a nozzle defined by a cylindrical sidewall in fluid communication with the bonnet and the core, the nozzle formed of aluminum, and the nozzle configured for creating a seal within an opening in a raidator tank at an interface between the nozzle and the opening of the radiator tank;

a corrosion-resistant material provided about at least a portion of the cylindrical sidewall of the nozzle; and a retaining compound for preventing an ingress of coolant at the seal, wherein the retaining compound comprises a methacrylate ester-retaining compound.

20. A radiator arrangement comprising:

a sectional radiator including a core and a bonnet;

a nozzle defined by a cylindrical sidewall in fluid communication with the bonnet and the core, the nozzle formed of aluminum, and the nozzle configured for creating a seal within an opening in a radiator tank at an interface between the nozzle and the opening of the radiator tank, wherein the seal comprises a grommet or a nitrile seal; and a corrosion-resistant material provided about at least a portion of the cylindrical sidewall of the nozzle.

21. A method comprising:

providing a corrosion-resistant surface about at least a portion of a cylindrical sidewall of an aluminum nozzle of a sectional radiator; and applying a retaining compound to a seal of the nozzle, the retaining compound configured for preventing an ingress of coolant at the seal, wherein the retaining compound is applied to a grommet or a nitrile seal as the seal.

22. A radiator arrangement comprising:

a sectional radiator including a core and a bonnet;

a nozzle defined by a cylindrical sidewall in fluid communication with the bonnet and the core, the nozzle formed of aluminum, and the nozzle configured for creating a seal within an opening in a radiator tank at an interface the nozzle and the opening of the radiator tank; and a corrosion-resistant material provided about at least a portion of the cylindrical sidewall of the nozzle, wherein the corrosion-resistant material comprises a sleeve including brass.

* * * * *